US007081593B2

(12) United States Patent
Hopkins

(10) Patent No.: US 7,081,593 B2
(45) Date of Patent: Jul. 25, 2006

(54) QUIET SNAP ACTION SWITCH

(76) Inventor: John David Hopkins, 3733 Shamrock St., Boise, ID (US) 83713-3769

( * ) Notice: Subject to any disclaimer, the term of this patent is extended or adjusted under 35 U.S.C. 154(b) by 0 days.

(21) Appl. No.: 11/014,094

(22) Filed: Dec. 15, 2004

(65) Prior Publication Data

US 2006/0131155 A1 Jun. 22, 2006

(51) Int. Cl.
*H01H 5/20* (2006.01)

(52) U.S. Cl. ..... 200/402; 200/200; 200/407

(58) Field of Classification Search ..... 200/402–407, 200/283, 430, 450–459, 468
See application file for complete search history.

(56) References Cited

U.S. PATENT DOCUMENTS

| | | | |
|---|---|---|---|
| 2,172,673 | A | 9/1939 | Eaton |
| 2,304,400 | A | 12/1942 | Eaton |
| 2,374,986 | A | 5/1945 | Fetter |
| 2,458,518 | A | 1/1949 | Kohl |
| 2,486,033 | A | 10/1949 | Kaminky |
| 2,510,021 | A | 5/1950 | Kaminky |
| 2,743,331 | A | 4/1956 | Lauder et al. |
| 2,849,580 | A | 8/1958 | Tateishi |
| 3,056,866 | A | 10/1962 | Karleen |
| 3,189,703 | A | 6/1965 | Chapin et al. |
| 3,248,959 | A | 5/1966 | Angold |
| 3,270,156 | A | 8/1966 | Stewart |
| 3,336,449 | A | 8/1967 | Ashman |
| 3,476,898 | A | 11/1969 | Ehrenfels et al. |
| 3,487,184 | A | 12/1969 | Arthur |
| 3,604,879 | A | 9/1971 | Beer |
| 3,878,347 | A | 4/1975 | Roeser |
| 4,130,747 | A | 12/1978 | Resh |
| 4,196,348 | A | 4/1980 | Iwakiri et al. |
| 4,253,001 | A | 2/1981 | Momozhane |
| 4,394,553 | A | 7/1983 | Feil |
| 4,644,115 | A | 2/1987 | Nishimori et al. |
| 4,673,778 | A | 6/1987 | Lewandowski et al. |
| 4,684,770 | A | 8/1987 | Pitrat et al. |
| 4,717,795 | A | 1/1988 | Urban |
| 4,902,863 | A | 2/1990 | Fukuma |
| 4,904,832 | A | 2/1990 | Nagahara et al. |
| 5,015,811 | A | 5/1991 | Moriyama et al. |
| 5,017,747 | A | 5/1991 | Nagahara et al. |
| 5,043,545 | A | 8/1991 | Yamashita et al. |
| 5,268,674 | A | 12/1993 | Howard et al. |
| 5,453,590 | A | 9/1995 | Mayer |
| 5,459,295 | A | 10/1995 | Ohta et al. |
| 5,717,177 | A | 2/1998 | Tsai et al. |
| 5,875,887 | A | 3/1999 | Tsai |
| 6,713,702 | B1 | 3/2004 | Lee |
| 2004/0069606 | A1* | 4/2004 | Lee ..... 200/402 |
| 2005/0109601 | A1* | 5/2005 | Collot et al. ..... 200/402 |

* cited by examiner

*Primary Examiner*—Michael Friedhofer
*Assistant Examiner*—Lisa Klaus
(74) *Attorney, Agent, or Firm*—Stephen M. Nipper; Dykas, Shaver & Nipper, LLP

(57) ABSTRACT

The present invention is a microswitch where the movable contact that is attached to a movable member is adjacent a fixed end of said movable member and not adjacent a free end of said movable member.

19 Claims, 4 Drawing Sheets

QUIET SNAP ACTION SWITCH

BACKGROUND OF THE INVENTION

1. Field of the Invention

The present invention generally relates to snap action electrical switches, and more particularly relates to snap action switches that are specifically configured for generally quiet operation.

2. Background Information

The computer mouse was invented in 1968 by Douglas Engelbart (U.S. Pat. No. 3,541,541). Since that time, computer mice have adapted to new technology, whether it be optical movement sensors, scroll-button wheels or ergonomics. One computer mouse component that has not kept pace with the times has been the microswitch. A microswitch used to signify manual input by the mouse's user, particularly through depression of a mouse "button" which thereby depresses a plunger or push button that operates to open and/or close an electrical connection within the microswitch itself.

These types of switches provide the user with tactile (feel) feedback (as the mouse button is depressed force must be overcome, the resulting pressure and the release of the pressure as the switch "snaps" can be felt by the user) as well as the classic "click" sound comprising audible feedback. The "click" sound caused by the internal spring of the switch snapping a movable contact into engagement with a fixed contact. The user can therefore both feel and hear the activation of the switch. In this manner, the two types of user feedback (tactile and sound) provided by use of these switches have remained unchanged and are still signature components of the computer mouse.

The problem addressed by the present invention relates to the audible feedback or "click" sound made upon activation of the mouse button. As computer usage becomes more of an integral part of our society, it becomes more and more desirable to eliminate unnecessary and otherwise bothersome sounds in many common settings where a quiet environment is of value. These settings include, but are not limited to, libraries, computer labs, offices, classrooms, testing centers, apartments, dorm rooms, etc. where unwanted noise would be a distraction. What is needed is a way to decrease or eliminate the "click" sound produced by computer mice while keeping, at least, the tactile feel of a standard computer mouse/microswitch. Embodiments of the present invention solve this need.

A snap action switch (as shown in FIG. 1) typically functions based upon the following principles. A push button contacting a moveable contact member (or "movable member") is pressed which results in the corresponding movement of the movable member. The moveable member is connected to a spring member positioned and designed to build up and then release applied force beyond a given amount. This produces the "snap" involved in a snap action switch. The spring is configured to be compressed to a certain point based upon its orientation in the switch, and then the compression is released as the spring is moved through an arc of motion. Thus, the user will feel initial resistance and then a release. Also, the spring puts a constant upward pressure on the moveable member, which will allow it to return to its original (default) position following activation.

A typical moveable member has two stable conformations, open and closed. The movable member has a first movable contact and a second movable contact. The first movable contact is configured for contacting an open type fixed contact (second fixed contact) and the second movable contact is configured for contacting a closed type fixed contact (first fixed contact). The movable member's open conformation is the inactivated state and in such a state the movable member's first movable contact will rest in contact with the open type (second) fixed contact. When the push button is pushed, the moveable member will snap into its closed position and its second movable contact will rest in contact with the closed type (first) fixed contact as long as pressure is maintained on the push button. Upon release of said pressure, the moveable member will move back to the open position bringing the first movable contact back into contact with the second fixed contact.

The "click" sound produced by such a microswitch is a result of the moveable contacts being snapped or banged against the fixed contacts. The release of force in the spring member of the switch contributes to the speed at which the movable contacts will make contact with the fixed contacts and thus, to the loudness of the click. Part of the tactile feedback a user feels may also be a function of resonation starting at the fixed contact and moving through the movable contact through the pushbutton and felt by the user. A higher level of tactile feedback is produced, however, by the snap action movement itself.

What is needed is the provision of a snap action switch that retains the tactile feedback of the prior art snap action switches, but which eliminates and/or reduces the audible feedback (clicking) sound typically associated with snap action switches. Embodiments of the present invention solve this need.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is an improved microswitch or "snap-action" switch. One embodiment of such a microswitch comprises a switch casing, a hole formed in the switch casing, a push button extending through said hole, a movable member for moving at least one movable contacts into contact with a fixed contact, and a compression spring for creating tension.

The microswitch casing has a first common terminal member and a second terminal member that is fixed to a base portion. The hole being formed in the upper cover of the switch casing. The push button being vertically movably inserted into the hole.

The movable member is provided with a first movable contact region, and optionally a second movable contact region. The movable member having a first end extending to a second end, the first end defining a fixed end portion, and the second end defining a free end portion. These two ends defining there-between a central portion. The first end being pivotally supported at the inner end portion of the first common terminal member at a base end portion thereof. The movable member having a top side surface and a bottom side surface. The first movable contact region adjacent the first end on the bottom side surface and facing a first fixed contact fixed to the inner end portion of the second terminal member. The optional second movable contact region is adjacent the first end on the top side surface and facing an optional second fixed contact. This second fixed contact may be fixed to the inner end portion of a third terminal member. The compression spring attaching to the movable member and extending to contact the switch casing.

In use, the push button is configured for controlling the movement of the movable member and its attached movable contact(s). Specifically, when the push button is depressed, the first movable contact region is brought into contact with the first fixed contact, and when the push button is released the contact between the first movable contact region and the first fixed contact is broken.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
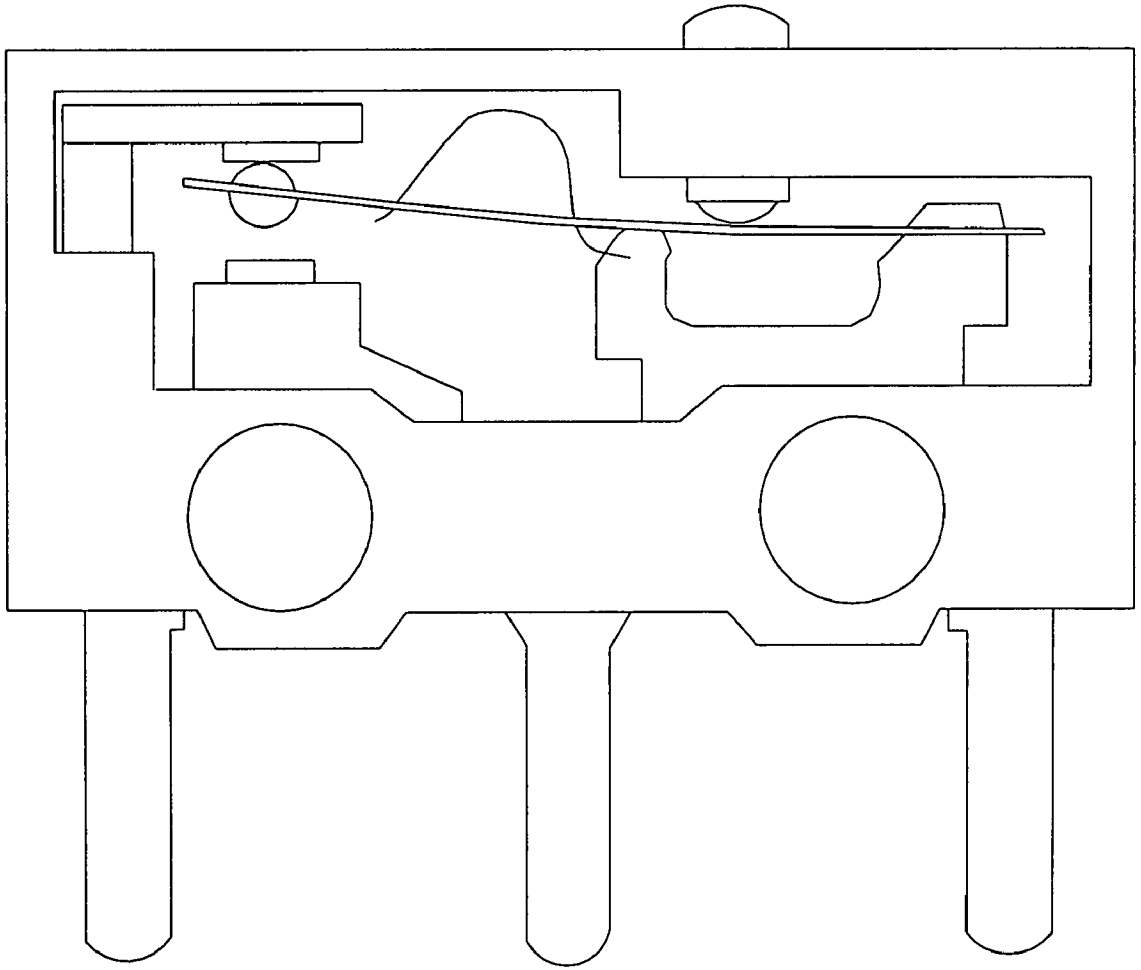
Fig. 1 (Prior Art)
FIG. 1 shows a side cross sectional view of one general embodiment of a prior art microswitch.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
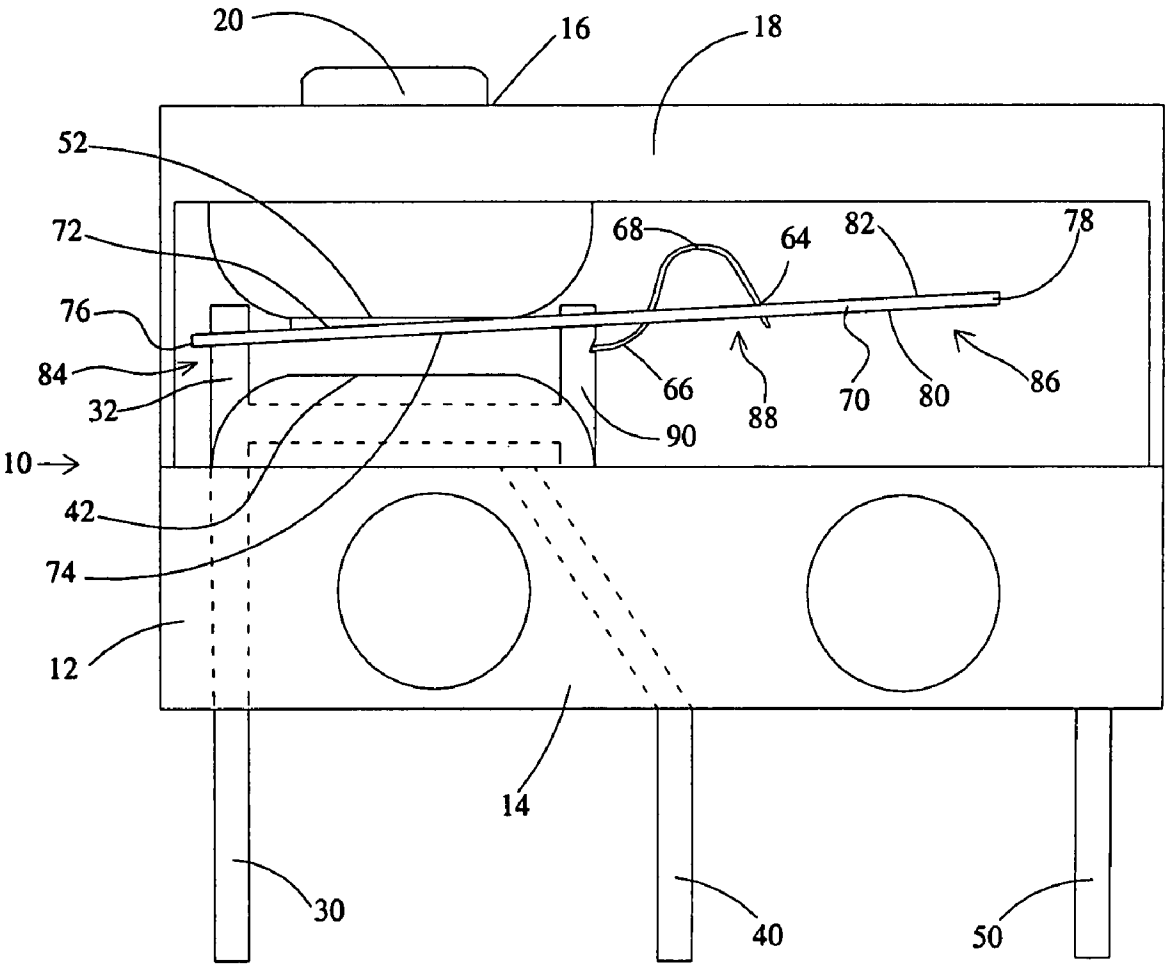
FIG. 2 shows a first cross sectional view of one embodiment of a microswitch of the present invention's construction showing the button not depressed.
Figure 3:
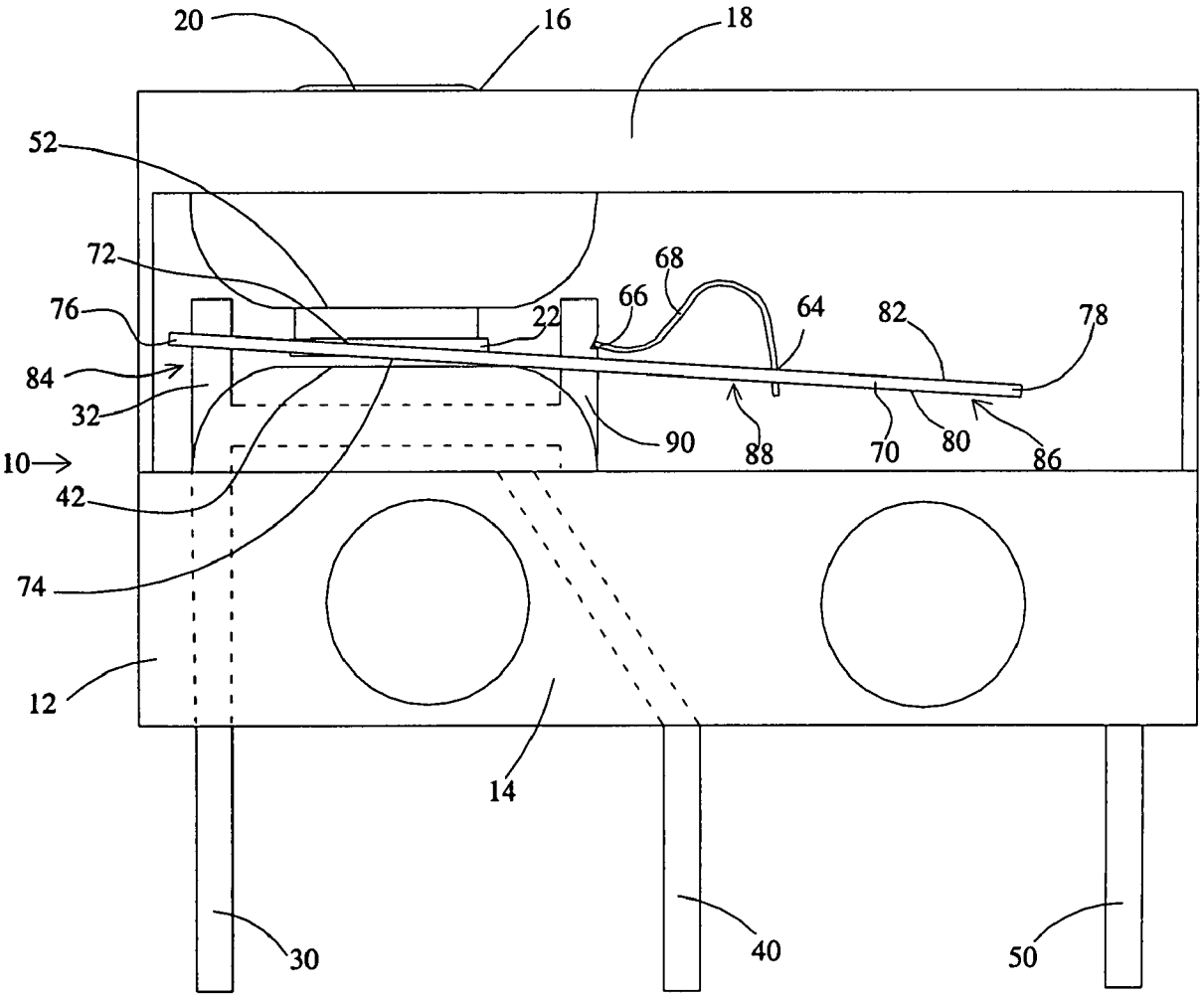
FIG. 3 shows a second cross sectional view of the embodiment of FIG. 2 showing the button depressed.
Figure 4:
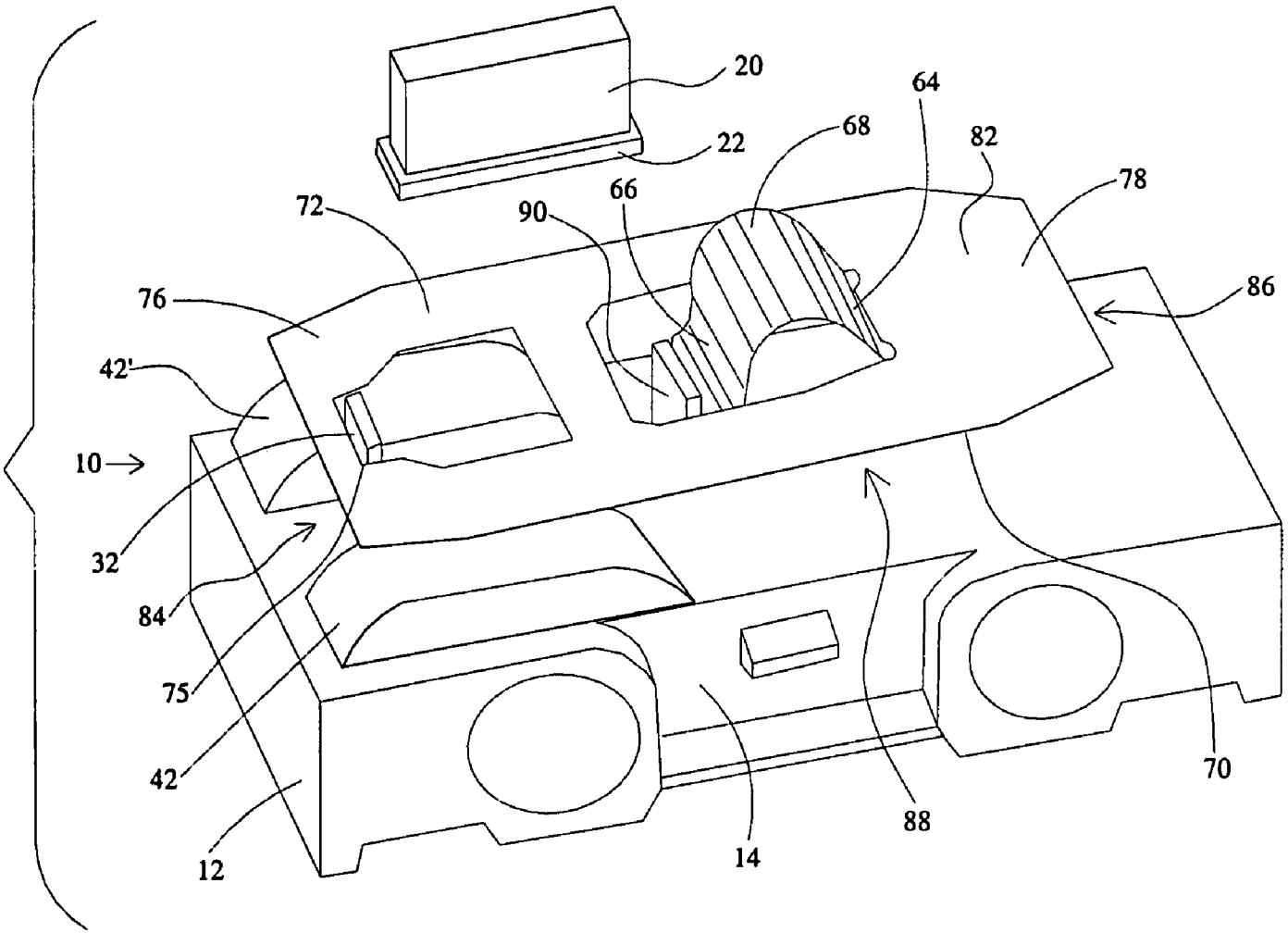
FIG. 4 shows a partial, perspective, exploded view of a second embodiment of the present invention.

Two different embodiments of the present invention are shown in the drawings (FIGS. 2–4). FIG. 1, as discussed above, shows a generic prior art embodiment of a microswitch or snap action switch. This prior art figure is intended to be general, showing generally how prior art microswitches operate and are configured. Of note is the concept that depression of the push button causes the moveable contact member to flex against the pressure of the compression leaf spring. When the push button applies enough pressure to the moveable contact member, the free end of the member snaps downwards, striking (and holding) the lower movable contact into engagement with the lower fixed contact (thereby closing (or opening) the circuit). When the push button is no longer depressed, the spring causes the moveable member to snap back into its default "open" position where the upper movable contact strikes and is held in contact with the upper moveable contact (thereby opening (or closing) the circuit). The act of the movable contacts striking the fixed contacts creates the characteristic "clicking" sound that emanates from a prior art microswitch during use.

Referring to FIGS. 2–3, shown is one embodiment of the present invention, namely a microswitch 10 having a switch casing 12 including a base portion 14 and an upper cover 18 attached thereto. Typically, the base portion 14 and switch casing 12 form one unit (the cover portion 18 is configured for snapping onto the base portion 14), as is shown in the prior art and further discussion of such prior art structure is not necessary.

Preferably extending from the bottom of the base portion 14 are a plurality of terminal members, as is standard with microswitches in the prior art. Shown are a first (common) terminal member 30, a second (closed) terminal member 40 and a third (open) terminal member 50. Obviously, the order of the terminal members (common, open, closed) could be changed. While the preferred embodiment shows the use of three terminal members, it is expressly envisioned that more or less terminal members could be provided depending upon the application and functionality of the microswitch. The terminal members are preferably for connecting electrically within a circuit.

Additionally, terminal members could be provided which are not used (for instance a microswitch having common, open and closed terminal members could be used but the switch may only be used in closed mode (switch is either open (common not electrically connected with open or closed)) or closed (common electrically connects with closed)). In such an embodiment, the open terminal member may be provided, but not used within the circuit.

Referring back to FIGS. 2–3, the first common terminal member (FCTM) 30 terminates in an inner end portion 32 configured for electrical connection to a movable member 70. This connection is generally at the movable member's first end 76. It is preferred that this connection with the movable member 70 be generally fixed, thereby creating a fixed end portion 84.

In the embodiment shown, the movable member 70, at its first end 76, has defined there-through an attachment orifice 75 configured to slip over the fixed end portion 84. Through use of the compression spring member 68 and its connection with the fulcrum portion 90, the movable member first end 76 is held upon the inner end portion 32 and thereby is "fixed" thereto. Of course, release of the spring member 68 from its connection to the fulcrum portion 90 and/or other portion of the casing would result in the opportunity to remove (detach) the movable member 70 from the inner end portion 32. As such, the term "fixed" does not necessarily mean permanently affixed there-to. Such a connection of a movable member to a switch casing and common terminal member is common to the prior art, in example U.S. Pat. No. 6,713,702 (Lee). The Figure also shows spring first end 64 and spring second end 66.

The second terminal member 40 is configured to extend through the base portion 14 to connect with a first fixed contact 42. Such a connection between a terminal member and a fixed contact is common in the prior art and no further discussion is necessary.

The switch casing 12 having an upper cover 18 defining therein a hole 16 through which a push button 20 is able to extend. It is preferred that the hole 16 be oriented (as the microswitch is assembled) over the movable member 70 between the movable member's fixed end portion 84 and the movable member's connection with the spring member 68, however the hole 16 could be located anywhere above the movable member between the fixed end portion 84 and the free end portion 86. The push button hole 16 is preferably generally rectangular in shape, preferably oriented generally perpendicular to the length (first end to second end) of the movable member).

It is preferred that a push button 20 extend through said hole 16. The push button 16 having a flange 22 configured for mating with the inside portion of the upper cover thereby keeping the push button 20 from falling out of the casing. The movable member 70, through tension created by the compression spring member 68, is configured for (by default) holding the push button flange 22 pressed against the inside portion of the upper cover. Depression of the push button 20 into the casing moves the movable member 70 (and its first movable contact region 74) into contact with the first fixed contact 42 (or contacts 42') thereby forming an electrical connection between the first common terminal member 30 and the second terminal member 40.

While the present invention takes into consideration the creation of an electrical connection between the movable contact and the fixed contact(s), it is likewise envisioned that the term "contact" could not necessarily imply an "electrical contact," but rather could imply a mechanical contact (i.e., one object touching another, for instance an optical switching device having no electrical contact other than the physical contact needed to stop the motion of the movable member, etc.).

Depression of the push button 20 causes inwards movement of at least a portion of the movable member 70. The moveable member 70 is interconnected to the spring member 68 so that movement of the moveable member 70 inwards results in compression of the spring member. The spring member 68, as many prior art springs are, is configured to be compressed (through depression of the push button 20) to a certain point and then if depressed beyond said certain point, the spring trips, releasing its compression, thereby allowing the free end 78 of the movable member 70 to move in an arc.

This has the effect of creating the same tactile feel of a standard (prior art) microswitch, but because the fixed contact(s) and movable contact(s) are not located adjacent the snapped free end 78, no striking (clicking) sound is created (in the prior art the movable contacts on the free end are snapped against the fixed contacts). As such, the push button's pressure upon the movable member (after the spring trips) brings the movable member's first movable contact 74 more gently (due to the moveable member's lower velocity of movement in the region adjacent the fixed end 84) into contact with the first fixed contact 42. Upon release of pressure upon the spring (push button is no longer depressed), the spring returns to its original (default) position, removing contact of the first movable contact 74 to the first fixed contact 42. In such a manner, a quiet snap-action microswitch can be created.

It is envisioned that the movable member 70 could be further configured with a second movable contact 72 for contacting a second fixed contact 52 thereby allowing additional functionality to the switch, if desired. This second fixed contact 52 configured for connection with a third terminal member 50.

It is preferred that the movable member 70 have a first end 76 extending to a second end 78 as well as a bottom side 80 opposite a top side 82. The first end 76 being generally fixed to the inner end portion 32 (as described above), thereby forming a fixed end portion 84 whereas the second end 78 being generally free thereby forming a free end portion 86. The fixed end portion 84 and the free end portion 86 defining there between a central portion 88.

It is preferred that adjacent this central portion 88 there be a fulcrum portion 90 upon which the movable member 70 can be leveraged through depression of the push button 20. In the preferred embodiment, this leveraging taking place through use of the compression spring 68 attaching between (or extending from) the movable member's central portion 88 and the fulcrum portion 90. In cooperation with a compression spring 68, the push button 20 is held in its default non-depressed position and the second movable contact 74 of the movable member 70 is held not in contact with the first fixed contact 42 of the second terminal member 40, but when the push button 20 is depressed, this force of the compression spring is overcome and the second movable contact 74 is brought into connection and contact with the first fixed contact 42.

As briefly mentioned above, optionally the present invention could further comprise a third terminal member 50. This third terminal member 50 electrically extending through the switch casing 12 for connection with a second fixed contact 52. It is preferred that the movable member 70 be held by default through use of the compression spring 68 and in connection with the second fixed contact 52. Thus, when the push button 20 is depressed, the contact between the first movable contact 72 of the movable member 70 and the second fixed contact 52 of the third terminal member 50 is broken and the second movable contact 74 of the movable member 70 is brought into electrical connection with the first fixed contact 42 of the second terminal member 40.

Because the present invention uses a spring structure and overall internal structure similar to that of the prior art, the microswitch of the present invention has a similar tactile feel to it. As such, the user is able to obtain the same tactile feel and the use of the microswitch integrates seamlessly into the use of similar products such as a computer mouse.

In this embodiment, one of the distinguishing characteristics between the present invention and prior art microswitches is the fact that the first fixed contact 42 and (optionally) the second fixed contact 52 are located adjacent the fixed end portion 84 of the movable member 70 instead of the free end portion 86 of the movable member 70.

For the convenience of the reader, the inventor includes a call-out number reference list:

10 microswitch
12 switch casing
14 base portion
16 hole
18 upper cover
20 push button
22 flange
30 first common terminal member
32 FCTM inner end portion
40 second terminal member
42 first (closed type) fixed contact
50 third terminal member
52 second (open type) fixed contact
64 spring first end
66 spring second end
68 compression spring member
70 movable member

72 second movable contact region
74 first movable contact region
75 attachment orifice
76 first end
78 second end
80 bottom side
82 top side
84 fixed end portion
86 free end portion
88 central portion
90 fulcrum portion While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A microswitch comprising:

a switch casing in which a first common terminal member, and a second terminal member are fixed to a base portion, said second terminal member having a first fixed contact attached thereto;

a hole formed in an upper cover of said switch casing;

a push button which is vertically movably inserted into said hole;

a movable member provided with a first movable contact, said movable member having a first end extending to a second end, said first end attached to said first common terminal member, said first movable contact adjacent said first end;

a fulcrum portion for serving as a fulcrum on which the movable member is leveraged through use of said push button; and a compression spring for biasing said movable member away from said first fixed contact;

wherein said push button is configured for controlling the movement of the movable member and its attached movable contact, wherein depression of said push button brings said movable contact into contact with said first fixed contact, wherein release of said push button removes said movable contact from contact with said first fixed contact.

2. The microswitch of claim 1, wherein said switch casing has a third terminal member fixed to said base portion, said third terminal member having a second fixed contact attached thereto.

3. The microswitch of claim 2, wherein said movable member is provided with a second movable contact region adjacent said first end.

4. The microswitch of claim 3, wherein said push button is configured for controlling the movement of said movable member and said movable contact regions, wherein depression of said push button brings said first movable contact region into contact with said first fixed contact and removes said second movable contact region from contact with said second fixed contact, and wherein release of said push button allows said spring to move said second movable contact region into contact with said second fixed contact and removes said first movable contact region from contact with said first fixed contact.

5. The microswitch of claim 4, wherein said movable member has a top side surface and a bottom side surface, wherein said bottom side surface comprises said first movable contact region and wherein said top side surface comprises said second movable contact region.

6. The microswitch of claim 1, wherein said push button is configured for controlling the movement of the movable member and said first movable contact region, wherein depression of said push button brings said first movable contact region into contact with said first fixed contact, and wherein release of said push button removes said first movable contact region from contact with said first fixed contact.

7. The microswitch of claim 1, wherein said movable member first end thereby defines a fixed end portion, said movable member second end thereby defines a free end portion, said ends defining there-between a central portion.

8. The microswitch of claim 7, wherein said compression spring has a spring first end extending to a spring second end, wherein said spring first end is pivotally engaged with said central portion of said movable member and said spring second end is pivotally engaged with said fulcrum portion.

9. The microswitch of claim 8, wherein said hole in said upper cover is located between said fixed end of said movable member and said central portion of said movable member.

10. A microswitch comprising:

a switch casing in which a first common terminal member, and a second terminal member are fixed to a base portion, said second terminal member having a first fixed contact attached thereto;

a hole formed in an upper cover of said switch casing;

a push button which is vertically movably inserted into said hole;

a movable member provided with a first movable contact, said movable member having a first end extending to a second end, said first end attached to said first common terminal member, said first movable contact adjacent said first end, wherein said movable member has a top side surface and a bottom side surface, wherein said bottom side surface comprises said first movable contact region;

a fulcrum portion for serving as a fulcrum on which the movable member is leveraged through use of said push button; and a compression spring for biasing said movable member away from said first fixed contact;

wherein said push button is configured for controlling the movement of the movable member and its attached movable contact, wherein depression of said push button brings said movable contact into contact with said first fixed contact, wherein release of said push button removes said movable contact from contact with said first fixed contact.

11. The microswitch of claim 10, wherein said switch casing has a third terminal member fixed to said base portion, said third terminal member having a second fixed contact attached thereto.

12. The microswitch of claim 11, wherein said movable member is provided with a second movable contact region adjacent said first end.

13. The microswitch of claim 12, wherein said push button is configured for controlling the movement of said movable member and said movable contact regions, wherein depression of said push button brings said first movable contact region into contact with said first fixed contact and removes said second movable contact region from contact with said second fixed contact, and wherein release of said push button allows said spring to move said second movable contact region into contact with said second fixed contact and removes said first movable contact region from contact with said first fixed contact.

14. The microswitch of claim 13, wherein said top side surface comprises said second movable contact region.

15. The microswitch of claim 10, wherein said push button is configured for controlling the movement of the movable member and said first movable contact region, wherein depression of said push button brings said first movable contact region into contact with said first fixed contact, and wherein release of said push button removes said first movable contact region from contact with said first fixed contact.

16. The microswitch of claim 10, wherein said movable member first end thereby defines a fixed end portion, said movable member second end thereby defines a free end portion, said ends defining there-between a central portion.

17. The microswitch of claim 16, wherein said compression spring has a spring first end extending to a spring second end, wherein said spring first end is pivotally engaged with said central portion of said movable member and said spring second end is pivotally engaged with said fulcrum portion.

18. The microswitch of claim 17, wherein said hole in said upper cover is located between said fixed end of said movable member and said central portion of said movable member.

19. A microswitch comprising:

a switch casing in which a first common terminal member, a second terminal member, and a third terminal member are fixed to a base portion;

a hole formed in an upper cover of the switch casing;

a push button which is vertically movably inserted into said hole;

a movable member provided with a first movable contact region and a second movable contact region, said movable member having a first end extending to a second end, said first end defining a fixed end portion, said second end defining a free end portion, said ends defining there-between a central portion, said first end pivotally supported at the inner end portion of the first common terminal member at a base end portion thereof, said movable member having a top side surface and a bottom side surface, said first movable contact region adjacent said first end on said bottom side surface and facing a first fixed contact fixed to the inner end portion of the second terminal member, said second movable contact region adjacent said first end on said top side surface and facing a second fixed contact fixed to the inner end portion of the third terminal member;

a fulcrum portion for serving as a fulcrum on which the movable member is leveraged through use of said push button, said fulcrum portion configured for contacting said bottom side at said central portion; and a compression spring, one end of which is pivotally engaged with a central portion of said movable member and said fulcrum portion;

wherein said push button is configured for controlling the movement of the movable member and its attached movable contact regions, specifically when the push button is depressed, the first movable contact region is brought into contact with the first fixed contact and when the push button is released, the second movable contact region is brought back into contact with the first fixed contact.

* * * * *